US005224474A

United States Patent [19]

Bloomfield

[11] Patent Number: 5,224,474

[45] Date of Patent: Jul. 6, 1993

[54] RETROFITTING GAS MASK VOICE AMPLIFIER UNIT WITH EASILY ACTUATED SWITCH MEANS

[76] Inventor: John W. Bloomfield, 53 Outpost La., Hilton Head, S.C. 29928

[21] Appl. No.: 711,538

[22] Filed: Jun. 10, 1991

Related U.S. Application Data

[63] Continuation-in-part of Ser. No. 663,136, Mar. 4, 1991.

[51] Int. Cl.[5] ..... A62B 18/08; A62B 19/00; H04R 25/00

[52] U.S. Cl. ..... 128/201.19; 128/206.17; 381/169

[58] Field of Search ..... 128/201.19, 206.16, 128/206.17; 381/169, 188, 187, 168, 183, 75; 181/21, 22; 379/430; 2/422, 5

[56] References Cited

U.S. PATENT DOCUMENTS

| | | | |
|---|---|---|---|
| 3,180,333 | 4/1965 | Lewis | 128/201.19 |
| 3,218,607 | 11/1965 | Brock et al. | 128/201.19 |
| 3,314,424 | 4/1967 | Berman | 128/201.19 |
| 4,122,302 | 10/1978 | Bobb | 381/158 |
| 4,508,936 | 4/1985 | Ingalls | 381/79 |
| 4,683,588 | 7/1987 | Goldberg | 381/61 |
| 4,736,740 | 4/1988 | Parker et al. | 128/201.19 |
| 4,885,796 | 12/1989 | Loftus et al. | 381/187 |
| 4,901,356 | 2/1990 | Bauer | 381/169 |
| 4,980,926 | 12/1990 | Noetzel | 381/188 |
| 5,138,666 | 8/1992 | Bauer et al. | 128/201.19 |
| 5,159,641 | 10/1992 | Sopko et al. | 128/201.19 |

FOREIGN PATENT DOCUMENTS

| | | | |
|---|---|---|---|
| 9107859 | 5/1991 | World Int. Prop. O. | 381/169 |

*Primary Examiner*—Edgar S. Burr
*Assistant Examiner*—Kimberly L. Asher
*Attorney, Agent, or Firm*—Keck, Mahin & Cate

[57] ABSTRACT

An electrical amplifier unit which removably attaches to a gas mask and includes a separate microphone for detecting voice sounds emitted by the wearer of the gas mask, circuitry for amplifying the detecting sound, and a loudspeaker for emitting the amplified sounds externally of the mask. The associated components, except for the microphone, are contained within a housing which can be disassembled and which also contains a removable battery pack. The housing also is sealed from the external environment when completely assembled. The circuitry amplifies and filters the signals converted by the microphone and supplies a signal to the loudspeaker which is enhanced in the high frequency range but limited in the low frequency range so that the emitted sound is crisp and intelligible voice sounds. The microphone attaches over the mechanical emitter of the mask remote from the amplifier unit and is connected to an adaptor which mounts the amplifier unit onto the mask. The adaptor attaches to the noise piece of the mask without disturbing the structural integrity of the mask.

16 Claims, 3 Drawing Sheets

RETROFITTING GAS MASK VOICE AMPLIFIER UNIT WITH EASILY ACTUATED SWITCH MEANS

PRIOR RELATED APPLICATIONS

This application is a continuation-in-part of co-pending U.S. patent application Ser. No. 07/663,136 filed Mar. 4, 1991, and entitled RETROFITTING GAS MASK VOICE AMPLIFIER UNIT. The full text and teachings o this prior application is incorporated herein by reference.

BACKGROUND OF THE INVENTION

The present invention relates to a gas mask attachment and more particularly to a modification to the retrofitting gas mask voice amplifier unit disclosed in the aforementioned application.

As discussed in the prior related application, the retrofitting gas mask voice amplifier unit was developed to compensate for the deficiencies of the mechanical emitter (also referred to as a diaphragm) provided on the gas mask. Such deficiencies include attenuation and distortion of voice information resulting in poor voice intelligibility and amplitude.

The amplifier unit is designed to retrofit to gas masks known and in use today and also new gas masks to be available in the future. However, because each mask differs in structure, adaptor structures have been and are continuously being designed to enable the amplifier unit to attach to the different mask structures. Such adaptors are disclosed in the aforementioned application which facilitate attachment of the amplifier unit to the M-17, M-40 and M-CU/2P gas masks used by the United States armed forces.

SUMMARY OF THE INVENTION

It is a primary object of the present invention to provide an electrical amplifier unit for attachment to a gas mask and particularly the gas mask used by the British armed forces.

It is another object of the present invention to provide an electrical amplifier unit which attaches to a gas mask without affecting the structural and functional integrity of the gas mask.

It is still another object of the present invention to provide an electrical amplifier unit and a separate microphone connected to the amplifier unit but attaching to the gas mask proximate a mechanical emitter remote from the attachment position of the amplifier unit to the gas mask.

Further objects of the invention include all of those listed in the aforementioned application.

Briefly, the present invention is directed to an electrical amplifier unit having analog electronics for amplifying and filtering voice intelligence originating by mouth within the protected environment of a gas mask. The amplifier unit removably attaches to a gas mask and includes a housing supporting electronic amplifying and filtering circuitry, a loudspeaker and a removably battery pack for driving the circuitry and the loudspeaker. A power switch is positioned inside the housing but is actuated from a switch ring that is mounted external to the housing.

The housing of the unit comprises a hollow barrel member which has two isolated compartments each open at one end. The compartments are separated by a wall which has several small holes therein communicating between the compartments. In one compartment, a printed circuit board supporting the electronic circuitry and the loudspeaker are mounted. The microphone is separate from the housing because it must attach over a mechanical emitter remote from the position at which the amplifier unit attaches to the gas mask.

An adaptor is provided which removably attaches over the nose piece of the mask. The adaptor includes a ring member on a face portion thereof having internal threads for receiving external threads on a mounting base of the amplifier unit. The adaptor further comprises conductive segments disposed on the face portion. An insulated conductor electrically connects the microphone to the conductive segments. Protruding from the mounting base are conductive pins which electrically connect with the amplifying circuitry inside the housing and make contact with the conductive segments when the mounting base is screwed into the adaptor.

The above and other objects and advantages will become more readily apparent when reference is made to the following description taken in conjunction with the accompanying drawings.

DETAILED DESCRIPTION OF THE DRAWINGS

Figure 1B:
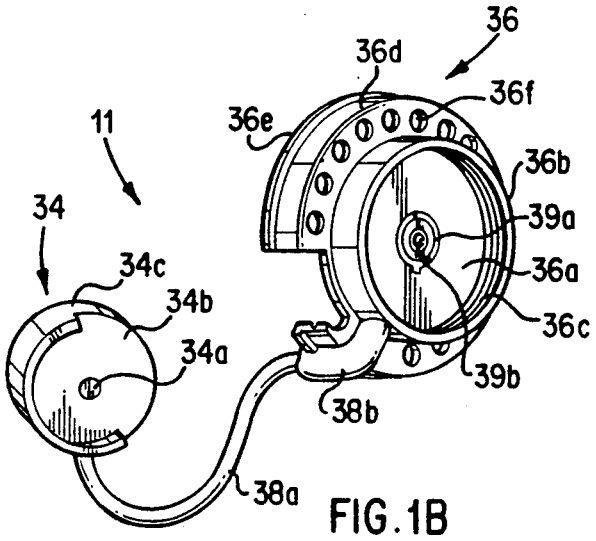
FIG. 1B is a perspective view of the microphone/adaptor assembly which attaches to a gas mask and electrically connects with the amplifier unit shown in FIG. 1A.
Figure 1A:
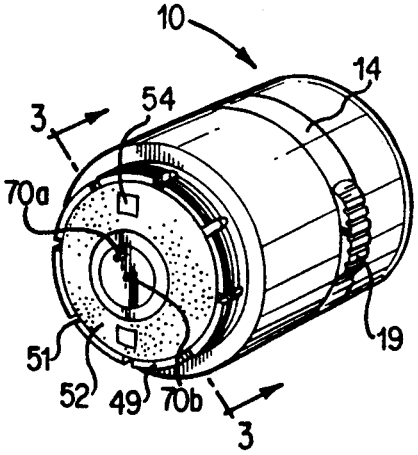
FIG. 1A is a perspective view of the retrofitting gas mask amplifier unit absent a microphone in accordance with the present invention.
Figure 2:
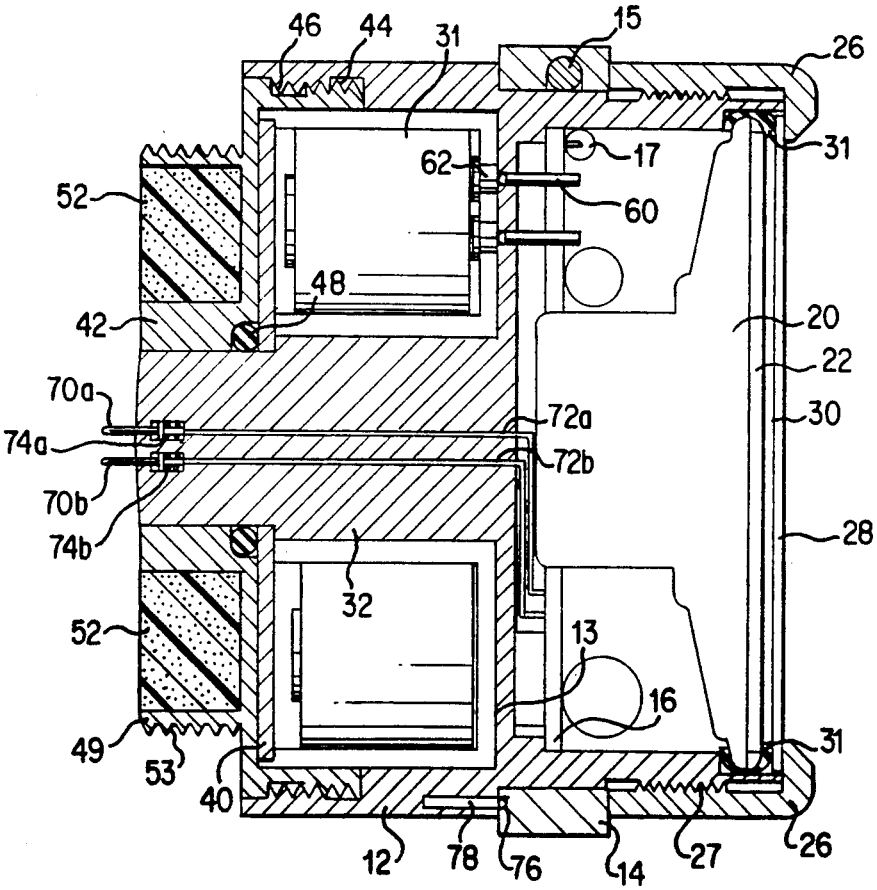
FIG. 2 is a cross-sectional view taken along line 3—3 of FIG. 2.

Referring first to FIGS. 1A, 1B and 2, the retrofitting gas mask amplifier unit is generally shown at 10. The gas mask amplifier unit 10 is similar to that disclosed in the prior application with the exception that the microphone is part of a separate microphone/adaptor assembly 11 (FIG. 1B). The voice sounds emitted by the mechanical emitter (otherwise known as diaphragm) forming a part of the gas mask are transferred to the amplifier unit 10 for amplification and emission from a loudspeaker contained in the amplifier unit 10.

Except for the voice microphone 34, the amplifier unit 10 is identical to that disclosed in the prior application, and includes all of the mechanical and electrical features disclosed in that application. Briefly, a barrel 12 serves as the housing of the unit 10, is open at both ends and comprises two compartments separated by a retaining wall 13 formed as an integral part thereof. A switch ring 14 slides onto the barrel 12 and is rotatable about the barrel between ON and OFF positions to remotely actuate a reed switch 17 inside the barrel via a magnet 15, as will be described in more detail hereinafter. The switch ring 14 includes handle members 19 at diametric opposing positions on the ring.

In one compartment of the barrel, a printed circuit board 16 fits snugly inside the barrel 12 on a shelf created at a step in the barrel 12. Glue is used around the edges of the printed circuit board 16 to secure it inside the barrel 12. A speaker 20 is mounted inside the barrel 12 next to the printed circuit board 16 also on a shelf and is pressed fit to snugly mount in the barrel 12. The speaker 20 comprises a mylar cone vibration member 22 which produces the sound and also seals the speaker 20 and the contents of the barrel 12 from the outside. A dust or sand screen is mounted over the speaker 20 and the barrel 12 is closed at this end by the front cap 26 which screws onto threads 27 of the barrel 12. The sand screen comprises a grill 28 and screen material 30. Furthermore, a rubber gasket 31 is provided around the periphery of the speaker 20 to seal the speaker 20 in the barrel 12.

In the other compartment of the barrel 12, a battery casing 32 is inserted into the barrel 12 and contains a plurality of batteries 31 in a donut shaped well 33 of the battery casing 32. The battery casing 32 is cylindrical and has a hollow passage in the center thereof. A snap-on lid 40 is provided to close the battery casing 32 and is removable by wedging the lid 40 off the casing 32 from the center hole thereof.

The barrel 12 is sealed at this end by a base 42 which has threads 44 that mate with threads 46 to screw into the barrel 12. An O-ring 48 is provided in a center passage of the base 42 to seal the inside of the barrel 12. A disc of sound dampening foam 52 is attached to the base 42 and received by ring member 49 and the projections 54 on the base 42. The ring member 49 is provided with external threads 53 having slots 51 therein, and serves to mount the amplifier unit 10 to the microphone/adaptor assembling 11 and hence the gas mask, without over-tightening.

FIG. 1B illustrates the microphone/adaptor assembly 11 which attaches to a gas mask and mates with the amplifier unit 10. The assembly 11 comprises a microphone 34 and an adaptor ring 36. The adaptor ring 36 is designed to attach to a gas mask and to receive the amplifier unit 10. Adaptor ring 36 comprises a face portion **36*a* encircled by a ring member 36*b* having internal threads 36*c* sized to mate with external threads 53 of the amplifier unit 10. Facing opposite the ring member 36*b* is a rim 36*d* having a circumscribing flange 36*e*. Holes 36*f* are provided on the face portion 36*a* outside of the ring member 36*b* for exhaust purposes. The rim 36*d* and flange 36*e*** are sized to snap-fit onto the nose piece of the gas mask, as will be described in more detail hereinafter.

The microphone 34 comprises a piezo-electric member **34*a* contained in a circular housing 34*b*. Circumscribing half of the perimeter of the housing 34*b* is a clip member having an internal slot (FIG. 6**) designed to fit over a mechanical emitter on a gas mask.

The microphone 34 is connected to the adaptor 36 by an insulated lead **38*a* which passes through a protective rubber connecting member 38*b*. To electrically connect the microphone to the internal electronics of the amplifier unit 10, a surface of the face portion 36*a* is coated with a conductive solder material. Specifically, a circular segment 39*a* and a semi-circular segment 39*b* each of conductive solder material is coated in the center of the face portion 36*a*. The insulated lead 38*a* contains two insulated conductors (FIG. 7) which electrically connect to the respective conductive segments 39*a* and 39*b***.

The battery casing 32 is connected to the printed circuit board via internal battery connector pins 60 shown in FIG. 2 which are part of the printed circuit board 16 and electrically connect to battery terminals 62 in the battery casing 32. In this regard, the housing is designed so that the battery pack fits in the housing in only one orientation to make contact with the connector pins 60. The microphone 34 electrically connects to the amplifier unit 10 via the conductive segments **39*a* and 39*b*. Specifically, conductive pins 70*a* and 70*b* are provided which extend from the base 42 and are electrically connected to the printed circuit board 16 by conductors 72*a* and 72*b*, respectively. The conductive pins 70*a* and 70*b* are biased outward by spring mechanisms 74*a* and 74*b***, respectively, which are well known in the art.

Like the amplifier unit disclosed in the prior application, the amplifier unit 10 includes the many mechanical features designed to waterproof the internals of the unit. First, the speaker 20 comprises a mylar cone speaker member which is impervious to fresh or salt water. In addition, the rubber gasket 31 provides a water tight seal between the front face of the speaker and the remaining housing. Second, the base 42 holding the battery casing in place is screwed to the barrel 12 so that a waterproof barrier is provided between the exterior and the batteries. Also, the O-ring 48 prevents leakage into the battery casing 32 through the center of the battery lid 40.

The internal ON/OFF power switch is identical to that disclosed in the prior application. Briefly, rotating the switch ring 14 in one direction to its furthest position (ON position) will cause the magnet 15 to align over the reed switch 17 which in response closes to connect the battery power supply to the associated circuitry. Rotating the switch ring 14 in the opposite direction will move the magnet 15 out of alignment with the reed switch 13 (OFF position), thus opening the reed switch and disconnecting the circuitry from the battery power supply.

The details of the several types of battery packs that may be used with the unit are the same as those described in the prior application.

Similarly, the details of the circuitry disposed on the printed circuit board 16 are described in the prior application, a specific incorporation by reference to those portions of the application being hereby made. Briefly, however, the thrust of the circuitry is to amplify and transfer any voice sound spoken from within the protected mask environment to the external world with a greatly improved volume and intelligibility level over that of a voice diaphragm alone. The circuitry is operative to disconnect from the power supply if no voice is detected for a preset period of time while the switch is in its ON position.

Reference is now made to FIGS. 3–7 which illustrate a British gas mask and the manner in which the amplifier unit 10 attaches to the gas mask. The amplifier unit 10 is designed to retrofit to the ga mask without harming the structural and functional integrity of the mask.

Figure 3:
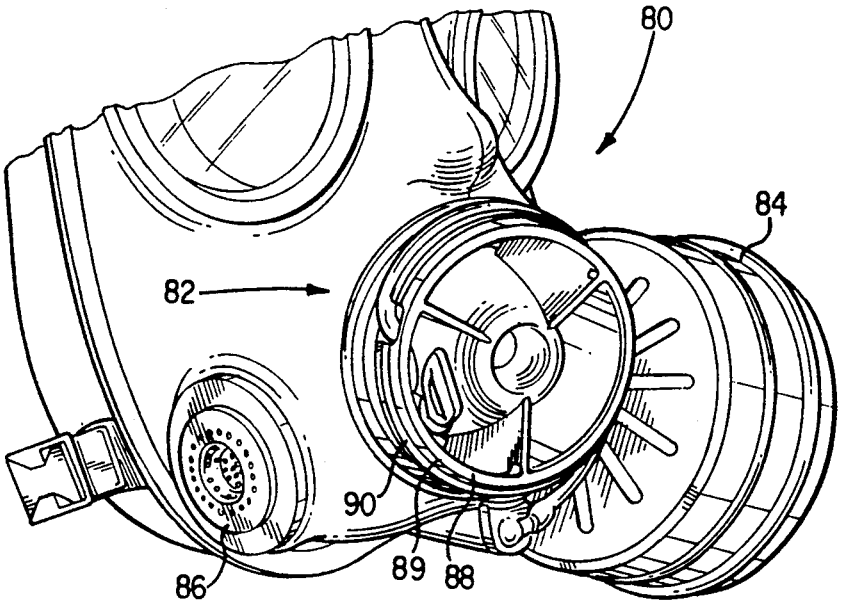
FIG. 3 is a perspective view illustrating a British gas mask as it appears in normal use without the amplifier unit attached.
Figure 4:
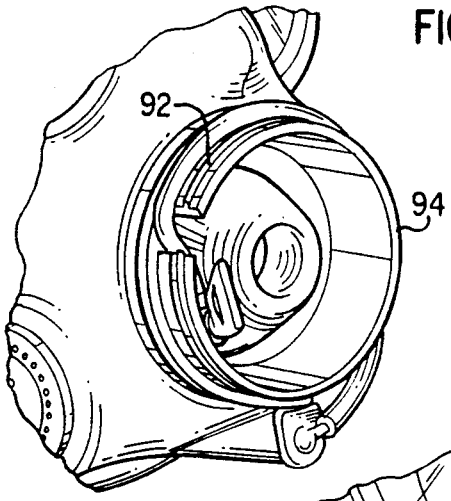
FIG. 4 is a perspective view of the internal nose piece portion of the British gas mask with the cap member removed.

FIG. 3 shows the gas mask at 80 which comprises a nose piece 82, a filter 84 and a mechanical emitter (voice diaphragm) 86, separate from the nose piece. The nose piece 82 comprises a circular cap member 88 that is removable to reveal the interior of the nose piece as shown in FIG. 4, but even with the cap member 88 removed, the nose piece is still sealed from the inside of the mask. Specifically, the cap member 88 includes a rim 89 having a flange 90 which snaps over a flange 92 of rim 94 on the nose piece 82. Rim 94 circumscribes the interior of the nose piece 82 and is not removable from the gas mask. The gas mask 88 is designed so that cap member 88 is removable from the mask to provide access for cleaning and decontaminating of the interior of the nose piece 82.

Figure 6:
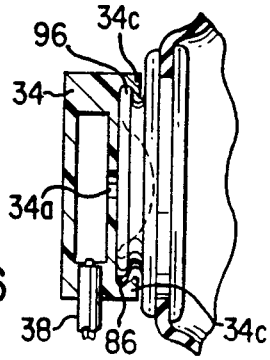
FIG. 6 is a cross-sectional view taken through line 6—6 of FIG. 5 and illustrating the microphone in position on the British gas mask.
Figure 5:
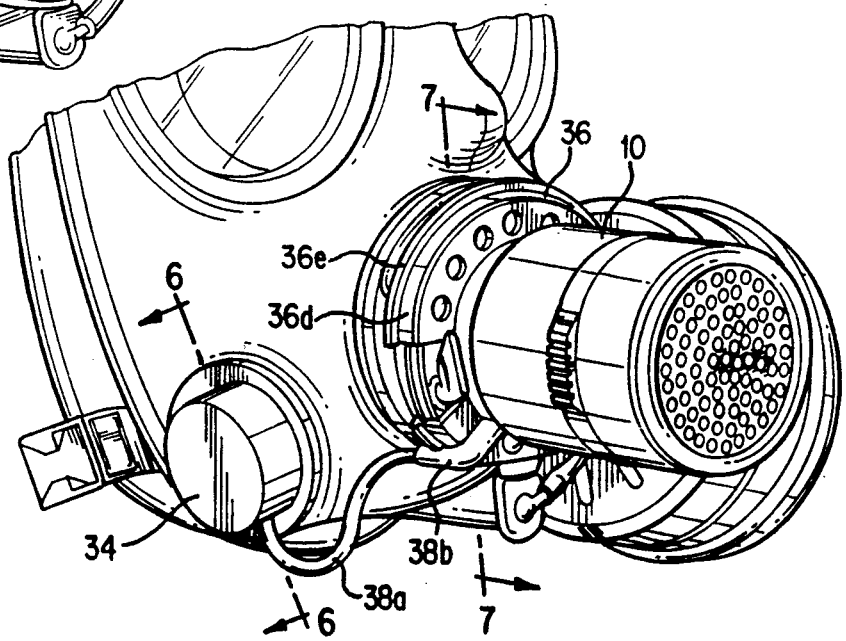
FIG. 5 is a perspective view of the amplifier unit attached to the British gas mask.
Figure 7:
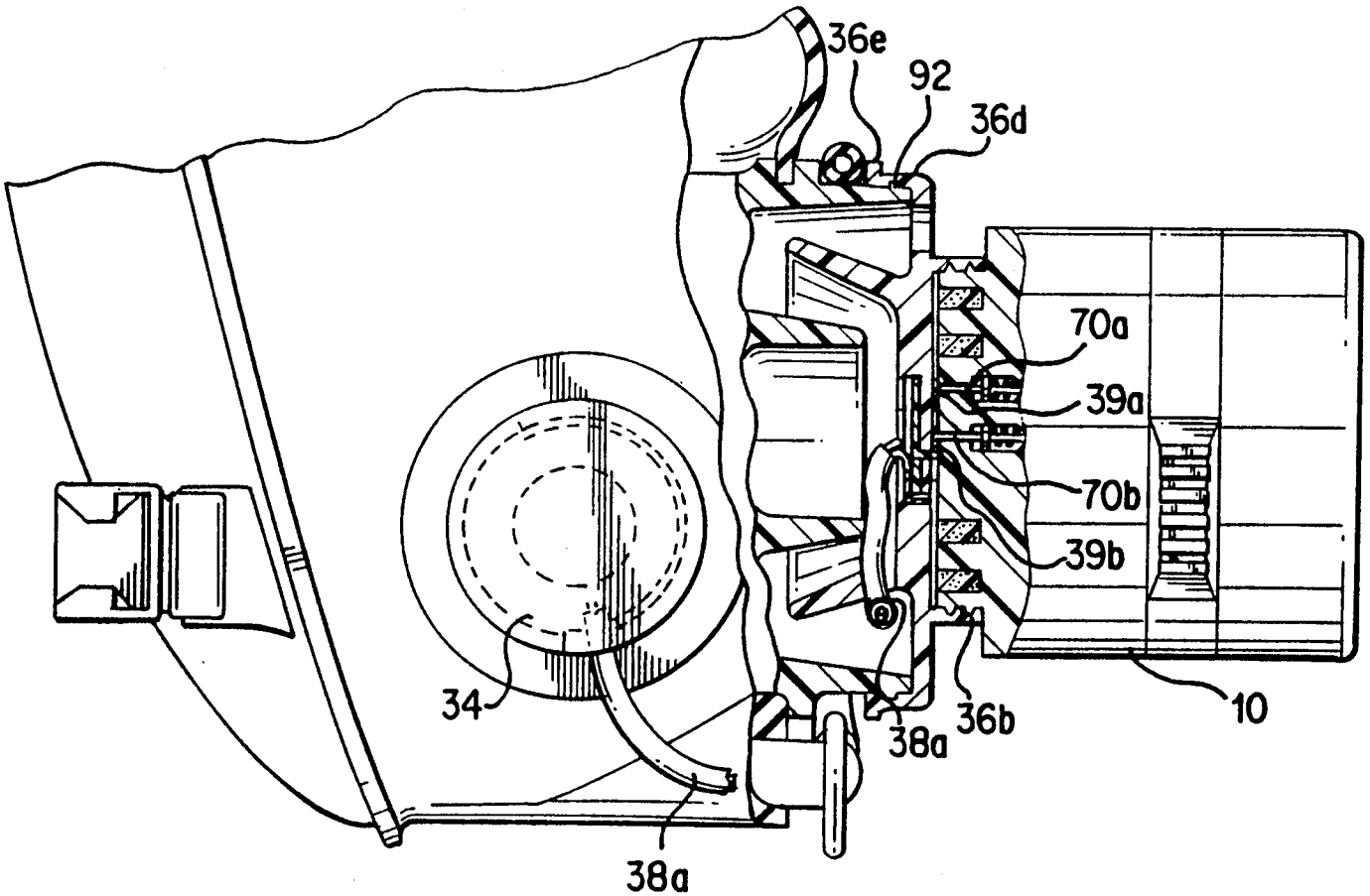
FIG. 7 is a partial cross-sectional view taken through line 7—7 of FIG. 6.

As shown in detail in FIG. 7, the adaptor 36 is designed to snap onto the rim 94 of the nose piece in the same manner that the cap member 88 attaches. That is, the flange 36*e* of the adaptor 36 snaps over the flange 92 on the rim 94 of the nose piece 82. Referring to FIG. 6, the microphone 34 fits over the mechanical emitter 86 whereby the clip member 34*c* fits over a flange 96 of the mechanical emitter 86. The adaptor 36 is removed from the nose piece 82 the same way the cap member 88 is removable. That is, in both the cap member 88 and the adaptor 36, a gap or interruption is cut in the rim thereof. This gap is used to receive a tool (such as a screwdriver or army knife) which is pivoted between the rim 36*d* of the adaptor 36 (or cap member 88) and the rim 94 of the nose piece to pry the flange 90 off the flange 92 off the rim 94.

As shown in FIG. 7, the amplifier unit 10 is attached to the gas mask (once the adaptor is attached as shown in the Figure) by screwing the base 42 into the ring member 36*b*. When the base 42 is screwed completely into the ring member 36*b*, the conductive pins 70*a* and 70*b* make electrical contact with the conductive segments 39*a* and 39*b*, respectively, on the face portion 36*a* of the adaptor 36. This establishes the electrical connection between the microphone 34 and the internal circuitry of the amplifier unit 10.

An important aspect of attaching the amplifier unit to the gas mask is that the structural and functional integrity of the mask 80 is not altered. In this regard, the adaptor 36 removably attaches to the mask in the same manner that the cap member 88 removably attaches to the mask, as aforementioned. Thus, the seal of the mask 80 which prevents contaminates from entering the interior of the nose piece 82 is not affected in any way. Moreover, the mask 80 can be modified quickly and with little additional effort to attach the microphone/adaptor assembly 11 and the amplifier unit 10 to the mask 80.

It is within the scope and spirit of the present invention that the amplifier unit 10 and microphone/adaptor assembly 11 can be attached to any type of gas mask which is similar in structure to the British gas mask.

The above description is intended by way of example only and is not intended to limit the present invention in any way except as set forth in the following claims.

I claim:

1. A device for attachment to a gas mask for amplifying voice sound comprising:

a barrel member;

a battery supply casing for receiving at least one battery and having output terminals, said battery supply casing being removably mounted in said barrel member;

a microphone/adaptor assembly comprising a voice microphone and an adaptor, said adaptor for removable attachment to a gas mask, an insulated conductor lead electrically connecting the voice microphone to the adaptor, said adaptor comprising a face portion and a ring member having internal threads disposed on said face portion, conductive segments being coated on said face portion and electrically connected to said insulated conductor lead;

a circuit board comprising electrical circuitry for amplifying the voice sound detected by the voice microphone, said circuit board comprising connection pins which electrically connect with the output terminals of said battery supply casing;

a power switch disposed inside said barrel member to connect and disconnect the electrical circuitry to and from said at least one battery;

a switching member comprising a ring which slides onto and rotates around the exterior of said barrel member between first and second positions for actuating the power switch to cause the power switch to connect and disconnect the electrical circuitry to and from the at least one battery;

loudspeaker means mounted inside said barrel member and electrically connected to said circuit board so as to emit sound outward through one of said first and second open ends of said barrel member;

first end cap means sealing said barrel member comprising a connecting portion which extends out from said barrel member and includes outer threads to mate with the internal threads of said ring member on said adaptor; and conductive pin means electrically connected to said circuit board and protruding out of said first end cap means so as to make electrical contact with said conductive segments on said adaptor for establishing electrical connection between the voice microphone and the printed circuit board.

2. The device of claim 1, wherein said barrel member comprises first and second open ends and said first end cap means is removably attachable to said barrel member at said first open end thereof.

3. The device of claim 2, and further comprising a second end cap means removably attachable to said barrel member at said second open end thereof.

4. The device of claim 3, wherein said first and second end cap means seal the respective interior portions of the barrel member for water and from chemical or biological agents.

5. The device of claim 1, wherein said power switch comprises a reed switch for connecting the electrical circuitry to said at least one battery when closed and disconnecting the electrical circuitry from said at least one battery when open, said switching member further comprising:

a permanent bar magnet attached in an interior surface of said ring facing the exterior of the barrel member, said permanent bar magnet closing said reed switch when said ring is in said first position at which the permanent bar magnet is position on the exterior of the barrel member in alignment with said reed switch for connecting the electrical circuitry to said at least one battery, and opening said reed switch when said ring is not in said first position.

6. A device for attachment to a gas mask for amplifying sound comprising:

a barrel member having first and second open ends providing access to first and second isolated compartments separated by a retaining wall traversing the interior of said barrel member, respectively, said first compartment comprising a well circumscribing a cylindrical passageway, said retaining wall comprising holes therethrough connecting the first and second compartments;

a battery casing for receiving at least one battery and having output terminals, said battery casing being removably mounted in the first compartment of said barrel member;

a microphone/adaptor assembly comprising a voice microphone and an adaptor, said adaptor for removable attachment to a gas mask, an insulated conductor lead electrically connecting the voice microphone to the adaptor, said adaptor comprising a face portion and a ring member having internal threads disposed on said face portion, conductive segments being coated on said face portion and electrically connected to said insulated conductor lead;

a circuit board comprising electrical circuitry for amplifying the voice sound detected by the voice microphone mounted in said second compartment of said barrel member;

connection pins connected to said circuit board and passing through the holes in the retaining wall to electrically connect with the output terminals of the battery casing;

first end cap means sealing said barrel member at said first open end thereof, said first end cap means comprising a connecting portion which extends out from said barrel member and includes outer threads to mate with the internal threads of said ring member on said adaptor;

conductive pin means electrically connected to said circuit board and protruding out of said first end cap means so as to make electrical contact with said conductive segments on said adaptor for establishing electrical connection between the voice microphone and the circuit board;

internal insulated electrical conductor means connected to said conductive pin means and passing through one of said holes in the retaining wall for electrically connecting with said circuit board;

a reed switch disposed on said circuit board inside said barrel member and capable of assuming a closed position to connect the electrical circuitry to said at least one battery and an open position for disconnecting the electrical circuitry from said at least one battery;

a ring member positioned around the exterior of said barrel member and rotatable about said barrel member a fraction of a full circle between ON and OFF positions, a permanent bar magnet being embedded in an inner surface of the ring member for cooperating with the reed switch so that when the ring member is rotated to said ON position, the permanent bar magnet is aligned over the reed switch on the exterior of the barrel causing the reed switch to close and thus connect the electrical circuitry to and said at least one battery, and when the ring member is rotated to said OFF position where the permanent bar magnet is not aligned over the reed switch on the exterior of the barrel member, the reed switch remains open disconnecting the electrical circuitry from said at least one battery; and loudspeaker means mounted inside the second compartment of said barrel member and electrically connected to said printed circuit board so as to emit sound outward through one of said first and second open ends of said barrel member.

7. The device of claim 6, and further comprising sealing means disposed adjacent said loudspeaker means to seal the second compartment of said barrel member from water and chemical or biological agents.

8. The device of claim 6, and further comprising filter means positioned in said second compartment of said barrel member adjacent to said loudspeaker means to prevent small dust and sand particles from entering said second compartment of said barrel member.

9. The device of claim 6, and further comprising second end cap means removably attachable to said barrel member at said second open end thereof to seal the second compartment of said barrel member from water and chemical or biological agents.

10. The device of claim 6, wherein said first end cap means is removably attachable to said barrel member at said first open end thereof.

11. A device for removably attaching to a gas mask for amplifying sound emitted by a wearer of the gas mask comprising:

microphone means for attaching to a gas mask proximate a mechanical emitter on the gas mask and converting voice sounds emitted by said mechanical emitter to an electrical signal;

housing means sealed from the external environment and containing:

circuitry including amplifying means for amplifying said electrical signal;

loudspeaker means connected to said amplifying means for converting the amplified electrical signal to sound;

a battery pack removably mounted in said housing means for providing a source of electrical energy to power the amplifying means;

power switch means connected between said battery pack and said amplifying means for connecting and disconnecting the electrical energy from said amplifying means;

means for connecting the microphone means to the circuitry in the housing means;

mounting means attached to said housing means for removably attaching said housing to a gas mask; and switch actuation means comprising a ring which slides onto and rotates around said housing between first and second positions for controlling said power switch means to connect or disconnect electrical energy of said battery pack from the amplifying means.

12. The device of claim 11, and further comprising an adaptor for removable attachment to a gas mask and comprising a face portion and a ring member having internal threads disposed on said face portion, conductive segments being coated on said face portion, an insulated conductor lead electrically connecting to the conductive segments and the microphone means.

13. The device of claim 12, wherein said mounting means comprises external threads which mate with the internal threads of said ring member of said adaptor, and wherein said device further comprises conductive pin means electrically connected to said circuitry and protruding from said mounting means so as to make electrical contact with said conductive segments on said adaptor for establishing electrical connection between the voice microphone and the circuitry.

14. The device of claim 11, and further comprising connection pins for connecting the battery pack with the circuitry, and wherein the battery pack mounts in said housing in a predetermined orientation so that said output terminals make electrical contact, with the connection pins.

15. In combination, a gas mask having a mechanical emitter and a nose piece on separate portions of the mask, said nose piece having a rim on the periphery thereof with a flange circumscribing the rim, an adaptor having a rim and a flange circumscribing the rim for snap fitting onto the rim of the nose piece of the gas mask for removably attaching the adaptor to the gas mask, microphone means removably attachable to said gas mask proximate said mechanical emitter for detecting sound emitted by said mechanical emitter and converting the sound to electrical signals, said adaptor being electrically connected to said microphone means and comprising electrical connection means, an amplifier unit having mounting means for removably mating with the adaptor for attachment to the gas mask, a ring member having internal threads, a face portion, said electrical connection means of said adaptor comprising conductive segments disposed on said face portion which make electrical contact with said pin connection means of said amplifier unit said amplifier unit comprising circuitry means for amplifying the electrical signals generated by said microphone means, pin connection means protruding from said mounting means for making electrical contact with said electrical connection means of said adaptor for electrically connecting said microphone means to said circuitry means, loudspeaker means for converting the amplified electrical signals to sound emitted externally of the gas mask, said mounting means comprises a cap member with external threads which mate with the internal threads of said ring member, means formed as part of said attachment means for preventing said mounting means from being overtightened in said ring member of the adaptor, where said means formed as part of said attachment means comprises slots formed transverse in said threads of said attachment means.

16. The combination of claim 15, wherein the size of the threads of the attachment means is slightly smaller than the size of the threads of the retaining ring so that said attachment means cannot be tightened past a predetermined torque in said retaining ring.

* * * * *